United States Patent [19]

Long

[11] Patent Number: 4,598,968

[45] Date of Patent: Jul. 8, 1986

[54] ELECTRICAL RECEPTACLE UNIT

[76] Inventor: Theron Long, 228 Hargrave Rd., Toledo, Ohio 43615

[21] Appl. No.: 292,591

[22] Filed: Aug. 13, 1981

[51] Int. Cl.[4] ..... H01R 13/74

[52] U.S. Cl. ..... 339/126 R; 339/122 R

[58] Field of Search ..... 339/122, 123, 120, 132; 248/27.1; 174/53, 54, 58

[56] References Cited

U.S. PATENT DOCUMENTS 1,829,896 11/1931 Glasgow ..... 174/54

1,999,194 4/1935 Hubbell ..... 248/DIG. 6

3,160,458 12/1964 Laudel et al. ..... 339/126 R X 3,860,739 1/1975 Kloth et al. ..... 174/58 X

*Primary Examiner*—Eugene F. Desmond

*Attorney, Agent, or Firm*—Paul R. Martin

[57] ABSTRACT

An insulated plug receiving device or receptacle unit adapted to be secured in position on a wall surface by means of a toggle bolt apparatus forming a part of the device, eliminating the necessity of a standard metal wall box and of attaching the receptacle unit to wall studs, thus making it possible to position the receptacle unit at any desired position on a wall, ceiling, or floor.

5 Claims, 6 Drawing Figures

ELECTRICAL RECEPTACLE UNIT

BACKGROUND OF THE INVENTION

The present invention relates to electrical receptacle units of the type adapted to receive plugs from toasters, irons, sweepers, and the like. Conventionally, electrical receptacles are contained within metal boxes mounted on wall or ceiling studs as a home is being constructed, and a unit consists of a metal box nailed to the stud, and the receptacle portion situated inside the box attached therto by means of screws.

After a home is rough wired, the dry-wall is installed, and the receptacle units are thereby fixed in place and substantially nonaccessible.

Occasionally, however, it is desired to install receptacles in older homes, or in new homes after the dry-wall has been installed. It is not then conveniently possible to attach a metal box to a stud, nor is it always desirable to locate the receptacle adjacent the stud.

To fasten a metal box to a stud would require the dry-wall to be torn out and an opening would have to be made which would be substantially larger than the metal box, thus requiring extensive plaster repairs after the box was in place.

The present invention overcomes these obstacles, and makes it possible to locate a receptacle unit anywhere on a wall, ceiling, or floor of a home or building without it having to be attached to a stud for support.

Prior efforts to solve this problem have not apparently been successful. Examples of such prior efforts, such as they are, can be found in U.S. Pat. Nos. 3,218,596, 3,716,651, and 3,609,647.

SUMMARY OF THE INVENTION

The invention relates to an electrical receptacle unit including an electrical receptacle, and an insulating cover, which is particularly adapted to be fastened to a wall without the use of a standard metal wall box.

As the receptacle unit of the invention needs no metal wall box there is no need to fasten the metal wall box to any supporting structure such as a wall stud, thus the unit can be located almost anywhere.

The receptacle unit of the invention has its own insulating box made of nonconducting flexible material to prevent contact with any current carrying parts of the receptacle.

A primary purpose of the invention therefore is to provide a plug receiving electrical device or electrical receptacle unit constructed so that it can be mounted or positioned anywhere on a wall, ceiling, or the like without the necessity of it being attached to studs in walls for support, and without using a standard metal wall box.

Another purpose is a receptacle unit of the type described which can be installed after a house has been dry walled.

Other purposes will appear in the ensuing specification, drawings and claims.

The receptacle unit, including the fastening device, is explained in the following drawings;

THE DRAWINGS

Figure 1:
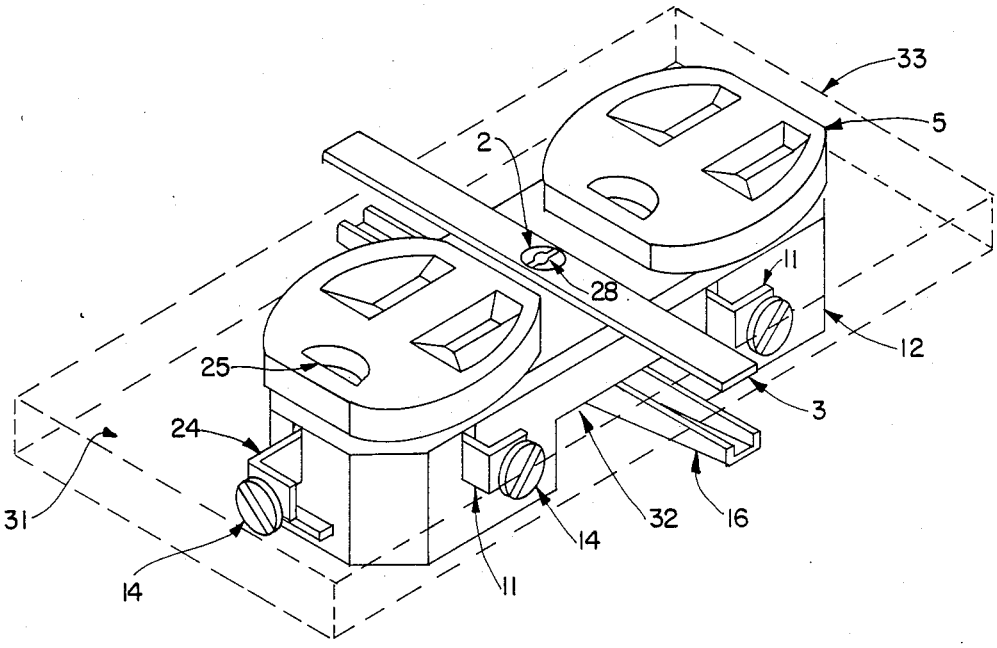
FIG. 1 is a perspective view of the receptacle unit, including the fastening device, seated in a rectangular opening in a flat surface.

Referring in greater detail to the drawings, I show in FIG. 1 a duplex receptacle unit with a fastening device. The receptacle unit comprises a cover 5, a hollow nonconducting casing 12, with electrical contacts 11, third wire contacts 24, and screws for fastening wires 14. The fastening device comprises a flat head bolt 2, drilled and tapped 28, to receive a standard screw for a cover plate 29, shown in FIG. 5. A rigid bar 3 engages cover 5 and the front side of a wall 33 and extends beyond the width of opening 31, with a circular opening 4, shown in FIG. 2, sec. A, beveled to receive the flat head bolt 2 so that when in position, the flat head of bolt 2 is flush with the rigid bar 3. A pair of wings 16 with a central threaded opening 35 shown in FIG. 2, sec. D and are positioned to receive bolt 2. The wings 16 will thread onto bolt 2 as bolt 2 is turned and apply pressure to rear of wall 33 and to bottom of casing depression 32 as bolt 2 is tightened.

Figure 2:
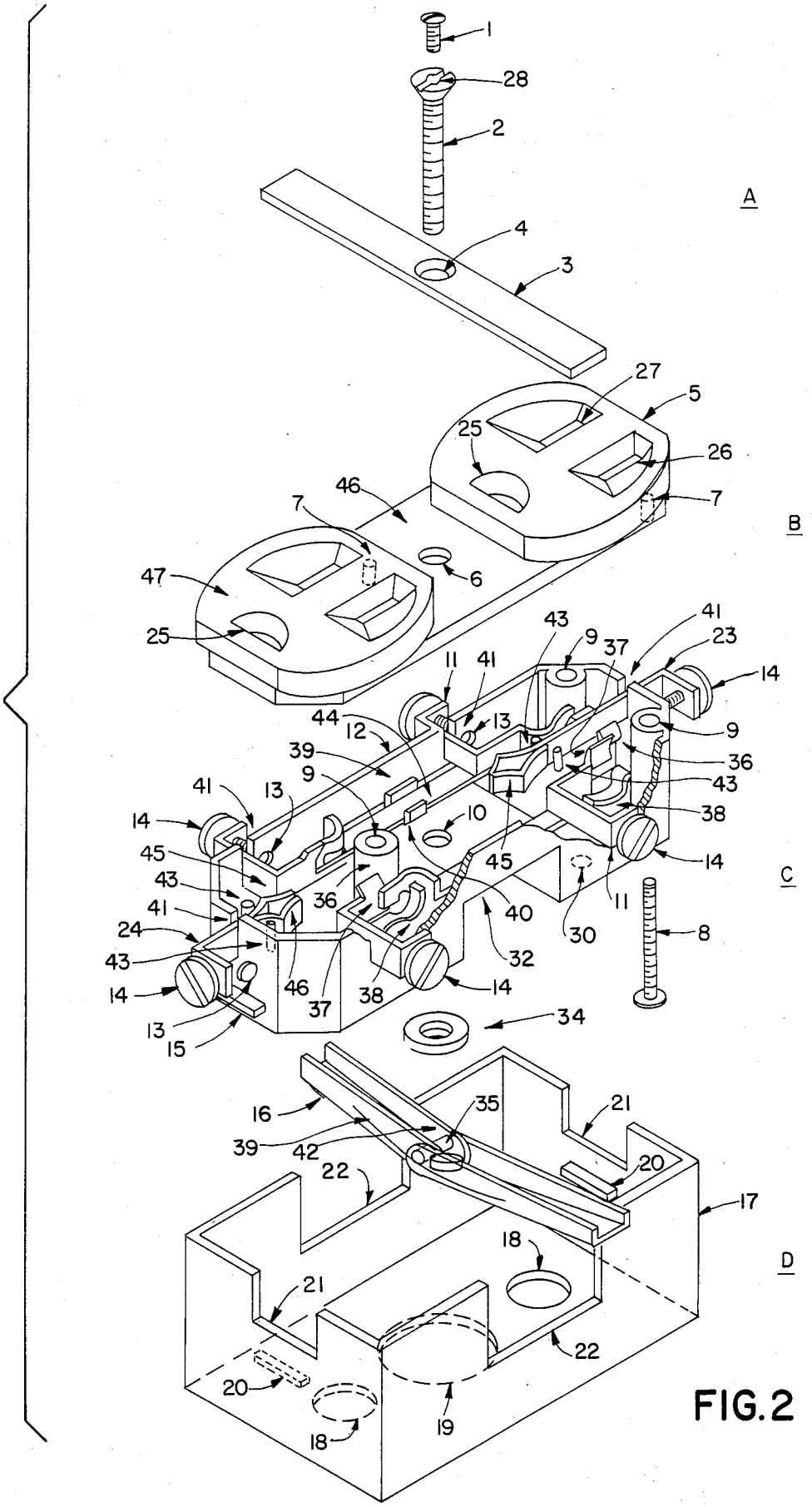
FIG. 2 is an exploded perspective view of the receptacle unit, including a receptacle, the fastening device and the flexible insulating box.
Figure 4:
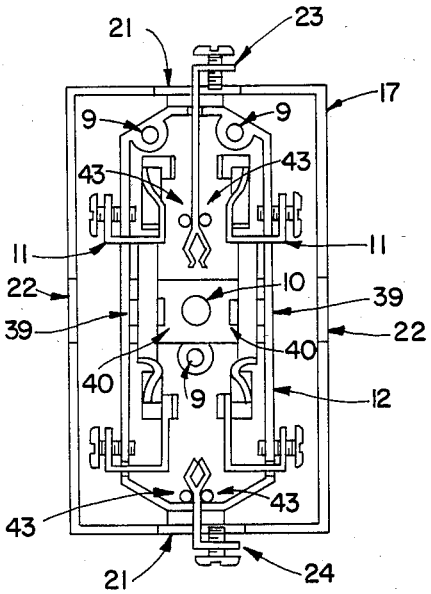
FIG. 4 is a top view of the casing of the receptacle in the receptacle unit, including electrical contacts and a front view of the flexible insulating box.

FIG. 2 is an exploded view of FIG. 1 in four sections, A, B, C, D, and in greater detail depicts, in section A, the screw 1 for the cover plate 29 shown in FIG. 4, and a drilled and tapped opening 28 in bolt 2 to receive screw 1. A rigid bar 3 is shown with an opening 4, beveled on the top side to receive bolt 2.

In section B is shown a receptacle cover 5 with opening 6 in the center to receive bolt 2 and two small cylindrical openings 7 at right end to receive screws 8 with a third opening 7 at center left to receive a third screw 8 which will secure cover 5 to casing 12. 25,26, and 27 depicts openings for a standard three prong electrical plug.

In section C is shown the casing 12 which holds the female electrical contacts 11, which also includes contacts 36, 37, and 38, by means of slots 41 in casing 12 and by means of raised lips 39 and 40 in the center section of casing. 23 and 24 are the third wire ground contacts held in casing 12 by slots 41 and also by pegs 43 molded in the casing 12. Openings 13 in casing 12 allow screws 14 to enter the casing if necessary. Opening 10 in casing 12 allows bolt 2, sec. A to pass through the casing to receive wings 16, sec. D. Opening 30 is to allow bare electrical wire to enter casing 12 and be secured to electrical contact 38 by means of spring pressure. Opening 30 appears on bottom of casing 12 in four places directly below the four contacts 38. Contacts 36 and 37 are spring pressured to allow male prongs of electrical appliance, etc. to be secured inside receptacle. 44 is a bar holding contacts 36, 37, and 38 together at both ends enabling current flow through out receptacle. 44 is also secured in casing 12 by means of lips 39 and 40 which prevent movement sideways. Contacts 23 and 24 also have springs 45 and 46 to accept third wire prong of male appliance plug. Channels 9, two in extreme right side of casing 12 and one in the center left of casing 12 allow screws 8 to pass through to secure themselves into holes 7 of cover 5 in sec. B, fastening cover 5, sec. B to casing 12, sec. C. A transverse depression 32 in casing 12 allows wings 16, sec. D to thread themselves onto bolt 2, sec. A far enough to allow wings 16, sec. D to engage rear of wall 33, FIGS. 1, 3, and 5, and at same time engage the bottom of depression 32 thus preventing any in and out movement through wall as rigid bar 3, FIG. 2, sec. A engages the front of wall 33 and cover 5, FIG. 2, sec. D.

The receptacle unit cannot rotate on bolt 2, FIG. 2, sec. A, due to bar 3, FIG. 2, sec. A fitting onto depression 46 of cover 5, FIG. 2, sec. B and raised portion 47 of cover 5, FIG. 2, sec. B cannot pivot past bar 3. Also casing 12, FIG. 2, sec. C cannot pivot past bar 3. Also casing 12, FIG. 2, sec. C cannot pivot past wings 16, FIG. 2, sec. D. 15 of FIG. 2, sec. C is a raised lip molded on each end of casing 12, FIG. 2, sec. C. Raised lips 20 of flexible cover 17, FIG. 2, sec. C pass over 15, FIG. 2, sec. D securing flexible cover 17, FIG. 2, sec. D to casing 12, FIG. 2, sec. C.

Section D shows a spacer 34 to allow for different thicknesses of walls. Spacer 34 will allow pressure to be applied to depression 32, FIG. 2, sec. C if wings 16, FIG. 2, sec. D engage wall before engaging depression 32 of casing 12, FIG. 2, sec. C. One or more spacers 34, may be needed but only one is shown in drawing. 17 is a hollow nonconducting flexible cover consisting of the following: Raised lips 20, as described in the preceding paragraph. Cut outs 22 to allow for wings 16. Cut outs 21 to allow for contacts 23 and 24, FIG. 2, sec. C. Holes 18 for passage of electrical wires through cover 17 and hole 19 for passage of bolt 2, FIG. 2, sec. D. 16 is further detailed in FIG. 6.

Figure 3:
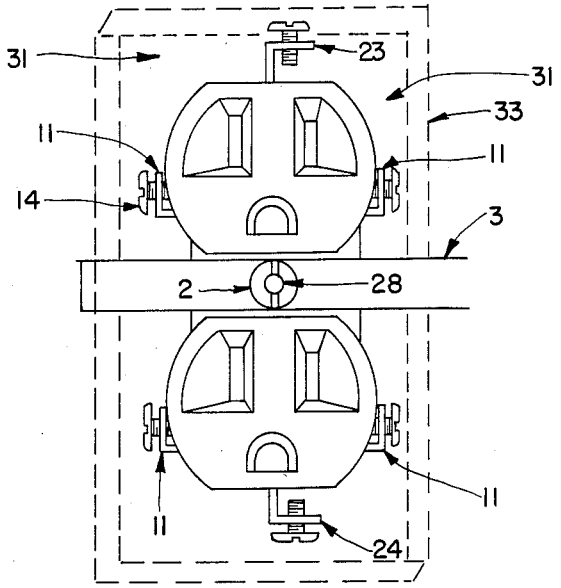
FIG. 3 is a face view of the receptacle unit situated within a rectangular opening with a rigid metal bar extending across the opening.

FIG. 3 is a view of the receptacle unit as it would appear in an opening 31 in wall 33 with the rigid bar 3 engaging the front of wall 33 with bolt 2 through, and flush with, hole 4, FIG. 2, sec. A of bar 3.

FIG. 4 is a top view of casing 12, FIG. 2, sec. C with flexible cover 17 FIG. 2, sec. D attached to casing 12, FIG. 2, sec. C.

Figure 5:
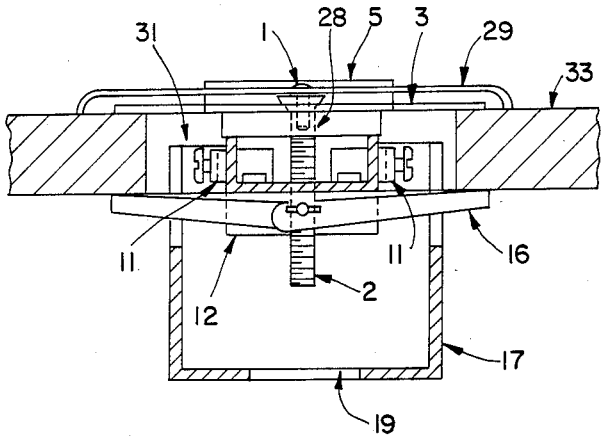
FIG. 5 is a top cross-sectional view of the complete receptacle unit, including the fastening device and insulating flexible box as it would be fastened into a wall, with a view looking down the wall from the top to bottom. Also included in this figure is a standard cover plate.

FIG. 5 is a view of the receptacle unit in opening 31 in wall 33 showing the rigid bar 3 engaging the front of wall 33, and bolt 2 passing through bar 3, casing 12, and wings 16. Flexible cover 17 is attached to casing 12 and cover plate 29 is secured by means of screw 1 passing into tapped opening 28 in bolt 2.

Figure 6:
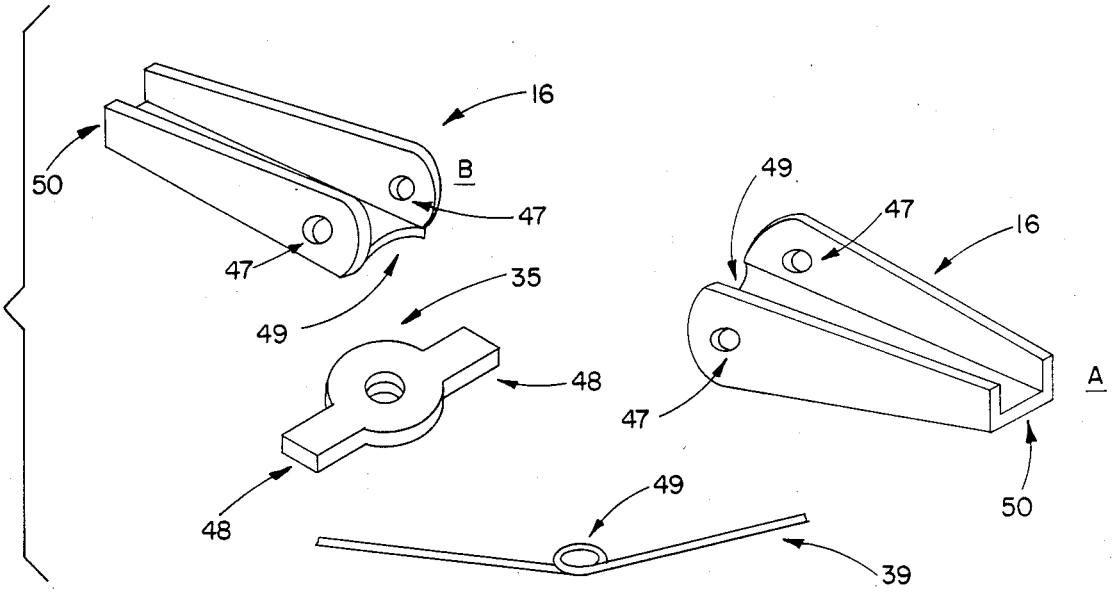
FIG. 6 is an exploded toggle apparatus showing the various parts thereof without the screw.

FIG. 6 is a detail of wings 16, showing one wing A and one wing B, each with openings 47 on one end. Wing A's outside dimensions are smaller than B's inside dimensions so that A will fit into B and openings 47 will align themselves to receive ends 48 of nut 35 with hole 49 of spring 39 affixed around either end 48 of nut 35 and tips of spring 39 applying pressure to troughs of wings A and B to keep them in a basic 90 degree angle from bolt 2, FIG. 2, sec. A. As bolt 2, FIG. 2, sec. A passes through nut 35 it will force ends 49 of wings A and B, which are slightly concave, away from each other, thus allowings ends 50 of wings A and B to slightly engage rear of wall before A and B engage depression 32, of FIG. 2, sec. C or spacer 24, FIG. 2, sec. D.

It should be clear that while the preferred embodiment of the invention has been shown and described, there are many modifications and alterations thereto which can be made yet falling within the scope of the following claims.

I claim:

1. An electrical receptacle unit comprising an electrical receptacle having a reduced thickness section intermediate two plug receiving stations, said reduced thickness section having a bore there through, a toggle bolt comprising a head, a shaft, and wings mounted on said shaft, the shaft thereof extending through said bore, a metal bar positioned on said shaft intermediate the head of the toggle bolt and the front surface of said reduced thickness section, whereby when said toggle bolt is tightened, said metal bar abuts the front surface of adjacent wall sections and the wings of said toggle bolt expand and abut the rear surface of adjacent wall sections, thereby securing said electrical receptacle unit tightly in place.

2. The electrical receptacle of claim one in which a flexible insulating cover is mounted on said receptacle, covering the rear thereof.

3. The electrical receptacle unit of claim 2 in which said flexible insulating cover is adapted to pop fit over the rear of said receptacle to enclose said receptacle and to protect the electrical contacts of said receptacle.

4. The electrical receptacle unit of claim one in which a cover plate is mounted on the front of said receptacle unit.

5. The electrical receptacle unit of claim 1, in which the head of said toggle bolt is flat, and in which said metal bar is mounted traverse to the longitudinal axis of said receptacle and has a beveled central opening through which said shaft of said toggle bolt extends and which beveled opening is adapted to receive said flat head of said toggle bolt, such that when said toggle bolt is tightened, said flat head and the surface of said metal bar are flush.

* * * * *